United States Patent [19]

Suzuki et al.

[11] 4,025,610

[45] May 24, 1977

[54] METHOD AND APPARATUS FOR DENITRIFYING COKE

[75] Inventors: Gyoichi Suzuki, Tokyo; Ryo Ando, Yokohama; Hideyuki Yoshikoshi, Tokyo; Seishiro Nagaoka, Kawasaki; Yogiro Yamaoka, Yokohama, all of Japan

[73] Assignee: Nippon Kokan Kabushiki Kaisha, Tokyo, Japan

[22] Filed: Dec. 13, 1974

[21] Appl. No.: 532,726

[30] Foreign Application Priority Data

Dec. 15, 1973 Japan ..... 48-139285
Dec. 15, 1973 Japan ..... 48-140931

[52] U.S. Cl. ..... 423/461; 13/7
[51] Int. Cl.[2] ..... C01B 31/02; H05B 1/00
[58] Field of Search ..... 13/7; 423/461

[56] References Cited

UNITED STATES PATENTS

| | | | |
|---|---|---|---|
| 598,549 | 2/1898 | Wing | 13/7 X |
| 1,671,673 | 5/1928 | Doerschuk et al. | 13/7 X |
| 2,681,943 | 6/1954 | Hartwick | 13/7 X |
| 3,578,069 | 5/1971 | Morel et al. | 13/7 X |
| 3,684,446 | 8/1972 | Markel | 423/461 X |

FOREIGN PATENTS OR APPLICATIONS

| | | | |
|---|---|---|---|
| 211,591 | 11/1957 | Australia | 423/461 |
| 126,574 | 6/1928 | Switzerland | 13/7 |

*Primary Examiner*—Leland A. Sebastian
*Attorney, Agent, or Firm*—Flynn & Frishauf

[57] ABSTRACT

A grain coke is packed in a vertical furnace between a pair of opposite electrodes for passing current through the coke, thus heating the same to a temperature of above 1400° C, preferably 1500° C for more than 10 minutes. Coke is loaded into the furnace from an upper portion and heat treated coke is cooled and then discharged from the bottom. Inert or reducing gas may be introduced into the lower portion of the furnace and discharged from the upper portion thereby cooling heat treated coke and preheating loaded coke.

19 Claims, 6 Drawing Figures

METHOD AND APPARATUS FOR DENITRIFYING COKE

BACKGROUND OF THE INVENTION

This invention relates to a method and apparatus for denitrifying coke.

Coke is used extensively in the art of metallurgy and various other industries, for example in blast furnaces, furnaces for sintering iron ore, etc. Generally, coke prepared in coke furnaces and cooked is used in such applications without any further treatment. However, such coke usually contains about 1 to 3% of nitrogen so that such coke generates poisonous nitrogen oxide, NOx, during use thereof. Accordingly, it was found that when ordinary coke is used for sintering iron ore, a large quantity of nitrogen oxide is generated.

SUMMARY OF THE INVENTION

Accordingly, the principal object of this invention is to provide a novel method and apparatus for denitrifying coke capable of decreasing the nitrogen content of the coke, thus decreasing a source of polution of the atmosphere.

Another object of this invention is to provide a new and improved method and apparatus for continuously and efficiently denitrifying coke.

Still another object of this invention is to provide an improved method and apparatus for denitrifying coke capable of operating at high efficiencies.

According to one aspect of this invention these and further objects can be accomplished by providing a method of denitrifying coke comprising the steps of packing a powder of coke in a furnace provided with spaced apart electrodes, and passing electric current between the electrodes through the grain coke for heating the same for more than 10 minutes to a temperature higher than 1400° C by the Joule heat generated by the current.

According to another aspect of this invention there is provided apparatus for denitrifying coke comprising a furnace having a coke loading opening at one end and a coke discharge opening at the opposite end, and a pair of spaced electrodes installed in the furnace whereby a grain coke packed in the furnace between the electrodes is heated by the Joule heat generated in the coke by the electric current flowing therethrough between the electrodes.

By heating the packed coke by the Joule heat generated by the electric current flowing therethrough it is generally possible to reduce the nitrogen content of the coke to a fraction of the original value, often to less than one tenth. The heating temperature is higher than 1400° C, preferably 1500° C, and the heating is continued more than 10 minutes. There is no upper limit for the heating time, but it is determined by the value of current, the volume of the furnace, etc. The resulting coke of reduced nitrogen content can be advantageously used for various purposes without forming a large quantity of nitrogen oxide.

The furnace is preferably of the vertical type which may be operated as a batch type or a continuous type. Further, the furnace may be provided with a gas circulating conduit including a dust collector, heat exchanger and a blower. The heat recovered by the heat exchanger may be used to preheat the coke to be packed in the furnace for improving the heat efficiency of the apparatus. Further, bypass conduits may be provided on the outside of the furnace for circulating inert or reducing gas through the lower portion of the furnace, through the bypass conduits and then through the upper portion of the furnace thereby cooling heat treated coke and preheating the loaded coke. The particle size of the coke may range from 1.0 to 10 mm or more. It is advantageous to pack coke of larger particle size near the inner wall of the furnace, whereby the resistance to the flow of gas at these portions is reduced thus increasing removal of heat and preventing local heating of the coke. This decreases erosion of the furnace wall by the local heating.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
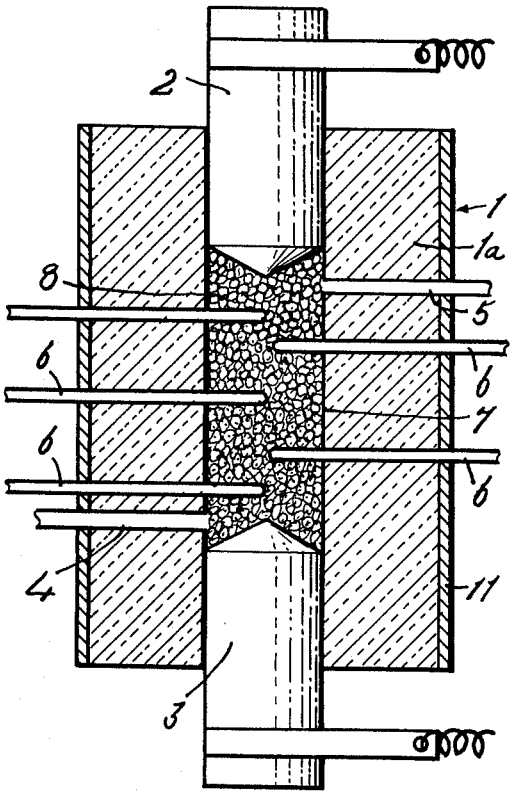
FIG. 1 is a diagrammatic longitudinal sectional view of a batch type furnace embodying the invention.

Referring to FIG. 1 which shows a batch type furnace embodying the invention, the furnace 1 comprises a steel casing 11, a refractory lining 1a for defining a heating chamber 7 adapted to contain coke 8, and a pair of graphite electrodes 2 and 3 mounted in the upper and lower portions of the chamber 7 to oppose each other. Inert or reducing gas is admitted into the lower portion of the chamber 7 through an inlet pipe 4 and discharged to the outside through a discharge pipe 5 provided at the upper portion of the chamber 7. A plurality of thermocouples 6 are inserted in the chamber 7 for measuring the temperature of various portions thereof. The furnace may be constructed as a vertical type as shown, or a horizontal type or inclined type.

Figure 2:
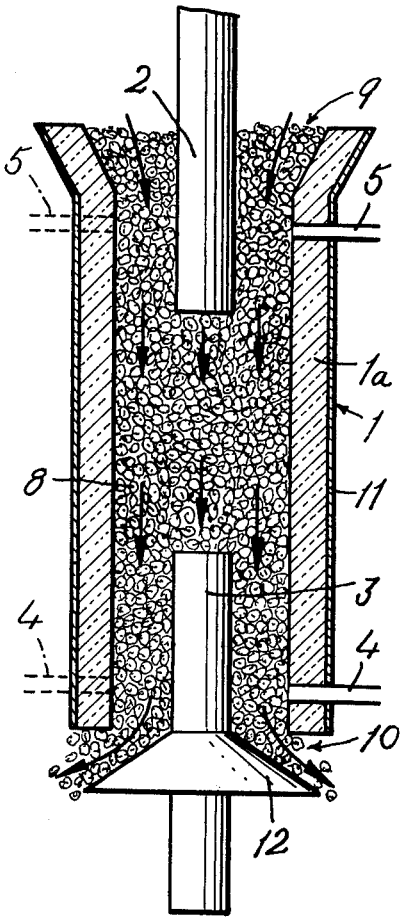
FIG. 2 is a similar view showing a continuous type furnace embodying the invention.

FIG. 2 shows a continuous type furnace 1 of the generally same constructed as that shown in FIG. 1. However, the diameter of the chamber 7 is increased and the upper portion thereof is flared outwardly to form a charging opening 9 about the upper electrode 2 and a flange 12 is provided for the lower electrode 3 to define a discharge opening 10 between the flange 12 and the lower end of the furnace 1. The coke 8 charged in the furnace through the charging opening 9 gradually descends and is finally discharged to the outside of the furnace throug the discharge opening 10. Although not shown, it should be understood that gas inlet pipe 4, outlet pipe 5 and the temperature measurement elements are also provided for the furnace shown in FIG. 2.

Figure 3:
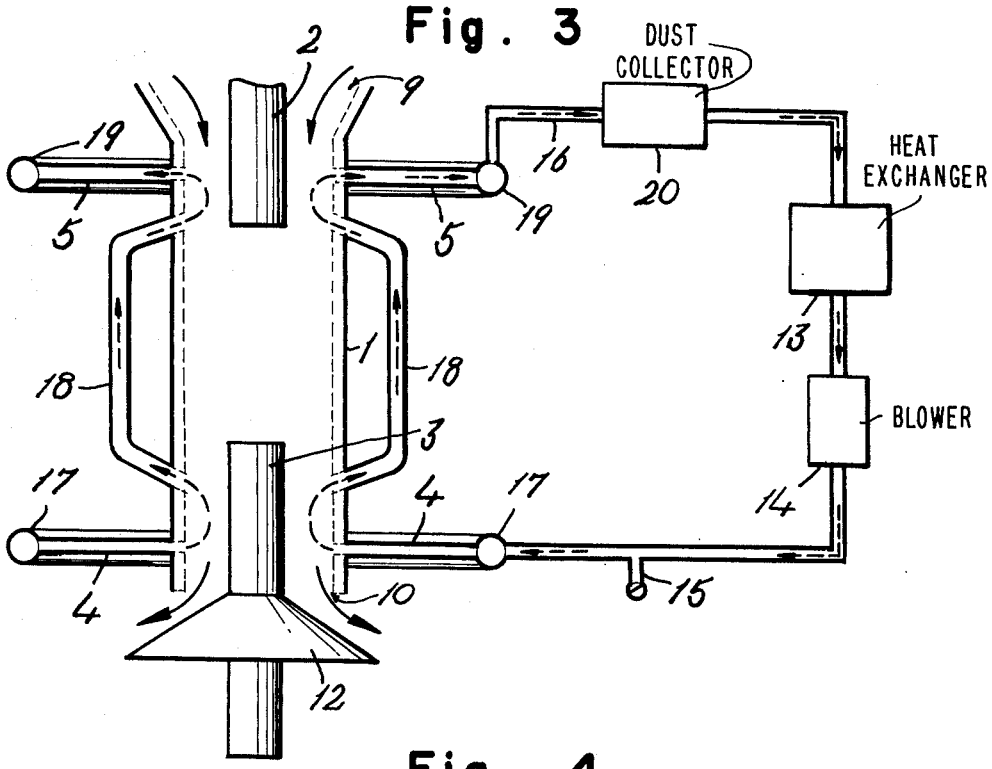
FIG. 3 is a modification of the furnace shown in FIG. 2 wherein a gas circulating system is added.

FIG. 3 shows a modification of the furnace shown in FIG. 2 in which a gas circulating system is added. More particularly, a gas circulating conduit 16 including a blower 14 is connected between the gas inlet pipe 4 and the outlet pipe 5 and bypass conduits 18 are provided between the inlet and outlet pipes 4 and 5 on the outside of the furnace for circulating gas through conduit 16, chamber 7, and bypass conduits 18. In this manner, the gas introduced in the lower portion of the furance is sent to the upper portion of the furnace through bypass conduits 18. Annular manifolds 17 and 19 are provided to encircle the lower and upper portions of the furnace, respectively. Thus, the gas collected in the manifold 19 through outlet pipes 5 is then passed through a dust collector 20 to remove dust and is then passed to blower 14 through a heat exchanger 13 in which the temperature of the gas is suitably regulated. The gas is then blown into the furnace through the lower manifold 17 and inlet pipes 4. Fresh gas is supplemented from time to time through a pipe 15 leading to a source of the gas, not shown.

Figure 4:
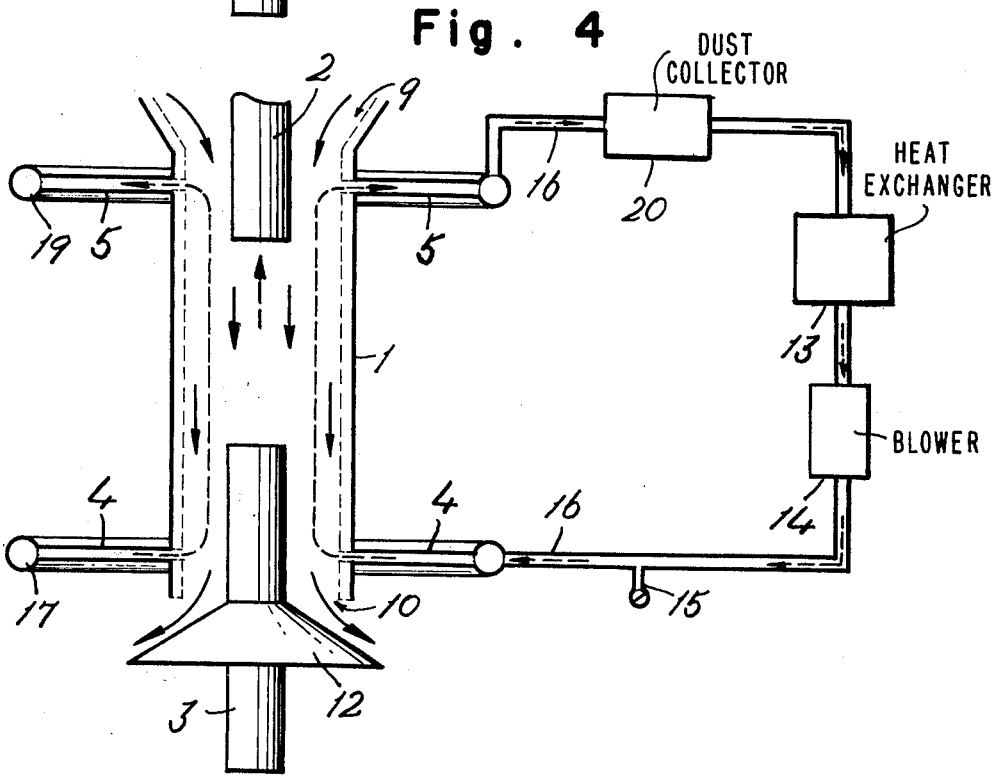
FIG. 4 shows a modification of the furnace shown in FIG. 3.

Depending upon the operating conditions of the furnace, especially when fine particles of coke is not used and where it is possible to select a suitable distribution of the coke loaded in the furnace, the bypass conduits 18 may be omitted as shown in FIG. 4.

Figure 5:
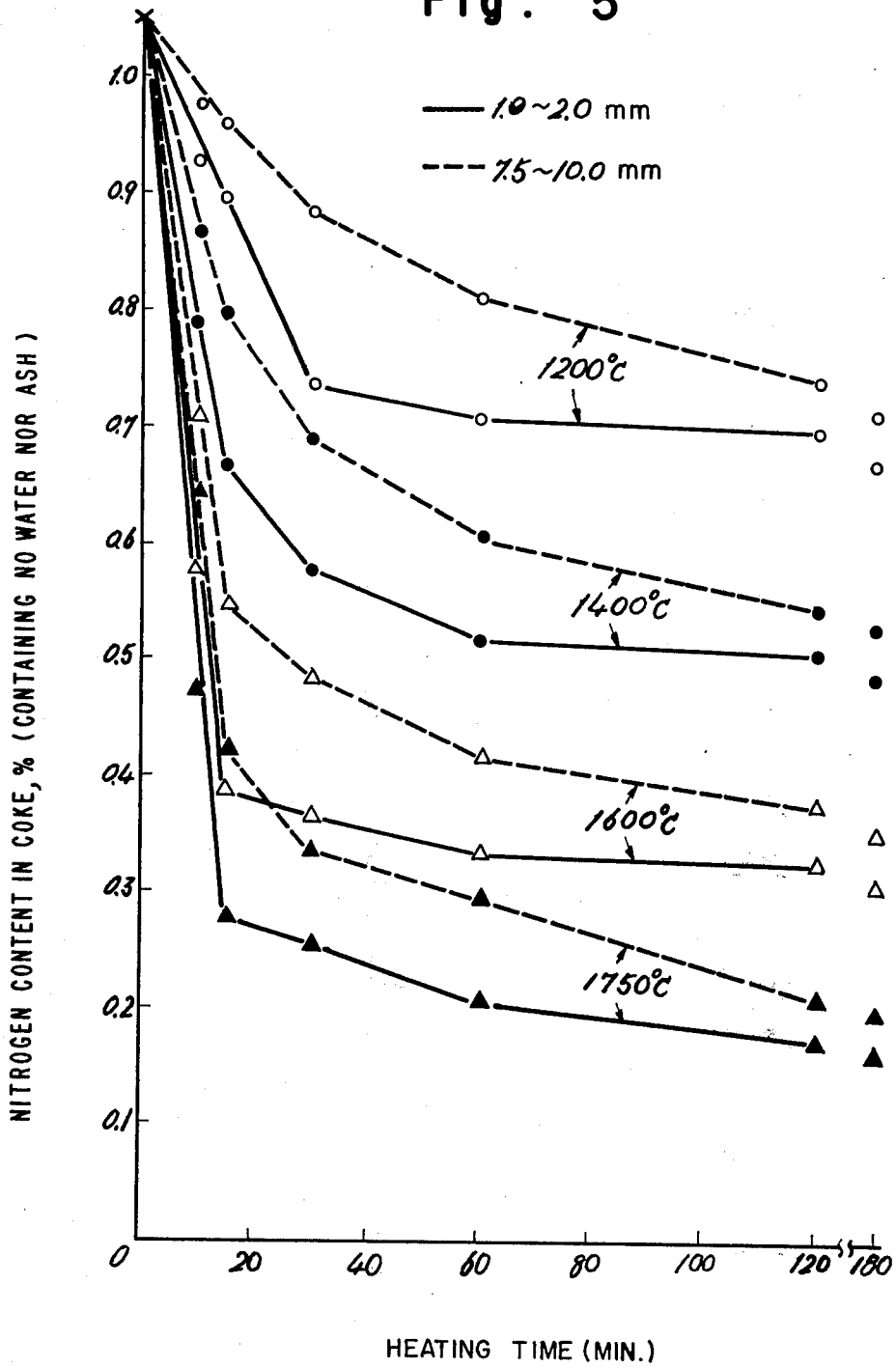
FIG. 5 is a graph showing the relationship between the stay (heating) time and the variation in the quantity of nitrogen contained in the coke and FIG. 6 is a chart similar to that shown in FIG. 5 wherein the method of this invention was applied to coke containing a relatively large quantity of nitrogen.

By using the apparatus shown in FIGS. 1 to 4 we have made various denitrification treatments under various conditions, and the results of the tests are plotted in FIG. 5. In these tests CO gas at a pressure of about one atmospheric pressure was used as the atmosphere circulated through the furnace, and coke having average particle sizes of 1.0 to 2.0 mm and 7.5 to 10.0 mm, respectively, was used. The coke was heated to a temperature of from 1200° to 1750° C by the heat generated by the Joule heat of current flowing between the electrodes 2 and 3. It was noted that the initial content of from 1.0 to 5% of the nitrogen in coke had decresed as shown in FIG. 5, in which curves were plotted for temperatures of 1200°, 1400°, 1600° and 1750° C, respectively, and for average particle sizes of 1.0 to 2.0 mm (solid lines) and 7.5 to 10.0 mm (dotted lines). The curves of FIG. 5 show that, when the heating temperature is less than 1500° C, it is impossible to decrease the content N in the coke to a desired extent irrespective of the particle size of the coke and the stay time or heating time. Thus, it is possible to decrease the nitrogen content to about 0.5% when coke having a particle size less than 10 mm is heated at a temperature of 1500° C for about one hour. As shown in FIG. 5 denitrification proceeds rapidly, in each case, at the early stages of heating. FIG. 5 also shows that irrespective of the particle size and heating temperature, the nitrogen content is greatly reduced within about 1 hour and that after 3 hours, denitrification does not proceed appreciably.

Figure 6:
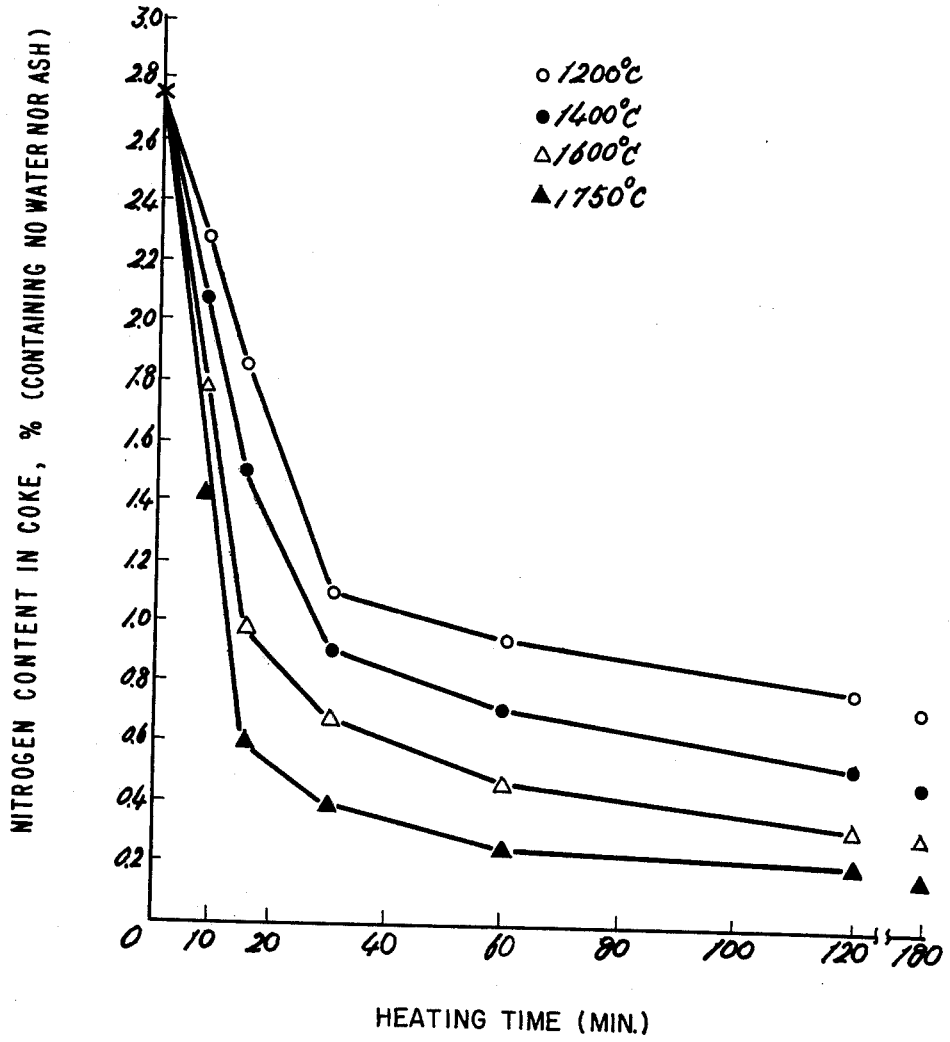

FIG. 6 shows decrease in the nitrogen content where coke containing relatively high percentages of nitrogen, for example 2.76%, was heated by electricity to the same temperatures as those shown in FIG. 5. Again the nitrogen content decreses rapidly during the initial 30minutes but very slowly after about 1 hour. After 3 hours denitrification does not proceed appreciably. As can be noted from FIG. 5 it is advantageous to use coke having a particle size of less than a predetermined value, for example 20 mm, and uniform particle size is preferred. Nonuniform distribution of the particle size results in nonuniform flow of the coke in the furnace thus making it impossible to uniformly denitrify. In any case it is not suitable to load coke having a large particle size of 1/10 or more of the inner diameter of the heating chamber.

In addition to CO, it is also possible to use $N_2$, Ar, $H_2$, He, etc. as the gas for forming furnace atmosphere, and it was noted that there was no extreme difference in the denitrifying speed or effect. Accordingly, any nonixidizing gas may be used.

Heat treated coke may be cooked to a temperature of about 200° C while it is still contained in the furnace or may be cooled to this temperature by using a suitable cooling gas after the coke has been discharged to the outside of the furnace. If such cooling is difficult or can not be advantageously carried out, it is possible to discharge the coke at a temperature of about 500° C and then cool it by loading it in a dry type cooling column, which may have the same construction as the furnaces shown in FIGS. 3 and 4. More particularly, cooling gas may be circulated through the cooling column through a conduit including a dust collector, a heat exchanger, which acts as a boiler in this case, and a blower. The heat regenerated by the heat exchanger may be used to preheat the coke to be loaded in the heating furnace thus improving the overall heat efficiency of the system. Generally speaking, the coke in the denitrifying section of the furnace is heated to a temperature of about 2000° C by the current flowing between the electrodes 2 and 3. The power required for this treatment amounts to about 1000 KWH per ton of coke. If the heat regenerated by the cooling column is used to preheat the coke as above described, it is possible to decrease the required power to about 400 to 500 KWH/ton of the coke.

Where bypass conduits 18 are used as shown in FIG. 3, it is possible to efficiently denitrify coke of small particle size of less than 5 mm, which manifests a large resistance to the flow of gas. Even when a furnace as shown in FIG. 4 is used, by loading coke having a large particle size, that is one affording a small resistance to gas flow, in regions neat the inner wall of the furnace it becomes possible to selectively recover the heat at portions neat the furnace wall. In other words, it is possible to decrease the heat loss from the furnace wall. In the furnace of the type shown herein, there is a tendency that the current distribution through the coke is not uniform near the furnace wall thereby causing local overheating and erosion of the furance wall. With the apparatus shown in FIG. 4, however, the gas flow assures uniform contact between coke particles and dissipates the heat at the overheated portion thus avoiding erosion of the furnace wall. This results in a stable operation of the furnace over an extended period. With the apparatus shown in FIG. 3 or 4, it is possible to cool the coke to a temperature of 200° C or less before it is discharged, thus rendering easy subsequent handling.

The coke denitrified as above described is advantageous to pulverize the resulting lumps to have particle sizes which vary depending upon the type of future use. For example, where the denitrified coke is used in sintering furnaces, the lumps as crushed to have a particle size smaller than 3 mm. The pulverized coke is admixed with a powder of iron ore or reclaimed iron ore to prepare a raw material for sintering in a manner well known in the art. For any metallurgical operation, the coke treated in accordance with this invention can greatly reduce the quantity of nitrogen oxide NOx gas produced. For example, in the sintering process described above, where conventional or nontreated coke is used, the quantity of the NOx gas produced amounts to 250 ppm and 450 ppm, respectively, where the raw material coke contains about % and 2% of nitrogen, respectively. On the contrary when coke treated by the method of this invention is used, it is possible to decrease the quantity of NOx gas to be less than 100 ppm.

To have a better understanding of the invention the following example is illustrated.

EXAMPLE 1.

Coke having a particle size of less than 35 mm, 60% of which has a particle size of less than 15 mm, and containing 2.8% of nitrogen was loaded in a denitrifying furnace as shown in FIG. 1, and a current of about 14 amperes was passed between electrodes 2 and 3 to heat the coke by the Joule heat of the current to a temperature of 1750° C for about 2 hours. The coke was then discharged from the furnace and cooled to room temperature. It was found that the contents of nitrogen had reduced to only 0.2%.

The resulting denitrified coke was then pulverized to a particle size of smaller than 3 mm. The pulverized coke was added to a raw material of sintering prepared in a manner well known in the art by using a powder of iron ore or reclaimed iron ore at a ratio of 5% and the mixture was loaded in pallets and sintered in a sintering plant. The NOx gas content of the gas exhausted from the sintering plant was measured to be from 56 to 63 ppm, the average value being about 60 ppm. If the coke was not denitrified by the method of this invention, the NOx gas content in the exhaust gas from sintering plant is generally about 600 ppm, which should be compared with said quantity of 60 ppm. Thus, it will be clear that this invention can greatly reduce the nitrogen content of coke, thus decreasing a source of pollution.

It should be clear that the denitrified said coke can be used in various industrial applications in addition to sintering of iron ore.

EXAMPLE 2.

Another portion of the same coke as mentioned in Example 1 was loaded continuously in a denitrifying furnace as shown in FIG. 3, and the same current as mentioned in Example 1 was passed between electrodes 2 and 3 to heat the coke to a temperature of about 1950° C.

Said denitrifying treatment was continued for about 5 hours, and the gas was circulated through the conduit 16 and the bypass conduits 18 in an amount of about 1200 $Nm^3$/ton of the coke. The gas cooled the discharged coke, and preheated the charging coke.

In this treatment the temperature of discharged coke was cooled to about 150° to about 200° C, and the charging coke was preheated to 950° to 1100° C when it was charged to the heating area. The temperatures of circulated gas were 400° to 500° C at the discharge pipe, 350° to 400° C at the inlet portion of heat exchanger, and about 100° C at the outlet portion of said heat exchanger. The required power was 460 KWH/ton of the coke.

What is claimed is:

1. A method for denitrifying metallurgical coke, wherein a metallurgical coke is packed into a vertical furnace having a coke loading opening at the upper end thereof and a coke discharge opening at the lower end thereof, characterized in that an electric current is passed along the coke loading-discharge line is said furnace between a pair of electrodes positioned at the upper and lower portions of said furnace in a downward and an upward direction, respectively, to generate Joule heat in said packed coke at a temperature greater than 1400° C. for more than 10 minutes in an inert or reducing atmosphere.

2. The method of claim 1, wherein said temperature is greater than 1500° C.

3. The method of claim 1, wherein the particle size of said metallurgical coke is less than 20 mm.

4. The method of claim 1, wherein the particle size of said metallurgical coke is from 1 to 10 mm.

5. The method according to claim 1 wherein the coke powder is continuously loaded into the upper portion of a vertical furnace, and the heat treated coke is continuously discharged from the lower portion of the furnace.

6. The method according to claim 1 wherein inert or reducing gas is admitted into the lower portion of said furnace and discharged from the upper portion of said furnace for cooling heat treated coke, and the heat of the atmosphere discharged from the furnace is used to preheat the grain coke before it is loaded in the heating zone of furnace.

7. The method according to claim 6 wherein the gas in the furnace is circulated by a blower installed in a circulating conduit connected between the upper end and the lower end of said furnace and the dust in said gas is removed by dust removing means also installed in said circulating conduit.

8. The method according to claim 7 wherein a heat exchanger is provided in said circulating conduit for preheating the coke to be loaded in said furnace by the heat recovered by said heat exchanger.

9. The method according to claim 1 wherein said grain coke has a particle size of less than 5 mm, furnace atmosphere is introduced into the lower portion of said furnace for cooling heat treated coke, then discharged to the outside of said furnace and again introduced into the upper portion of said furnace for preheating the coke loaded in said upper portion.

10. The method according to claim 1 wherein the coke is packed in said furnace with such grain size distribution that the resistance to the flow of furnace atmosphere through the packed grain coke decreases towards the furnace wall thereby selectively recovering the heat generated in the packed coke at portions thereof near said furnace wall and preventing local overheating of the packed coke due to nonuniform distribution of current.

11. Apparatus for denitrifying metallurgical coke, comprising a vertical furnace having a coke loading opening at the upper end thereof and a coke discharge opening at the lower end thereof, characterized in that a pair of electrodes are positioned in said furnace, one electrode being positioned at the upper portion thereof in a downward direction and the other electrode of the pair being positioned at the lower portion thereof in an upward direction, whereby electric current passed between said electrodes heats said metallurgical coke packed in said furnace by Joule heat generated by said current.

12. The apparatus according to claim 11 which further comprises a gas inlet port near said discharge opening for admitting inert gas or reducing gas and a gas discharge opening near said coke loading opening.

13. The apparatus according to claim 11 wherein said furnace is of the vertical type and said electrodes close the coke loading opening and the discharge opening thereby operating said furnace as a batch type.

14. The apparatus according to claim 11 wherein said furnace is of a vertical type and said electrodes are spaced from the furnace wall thereby permitting continuous loading and discharging of the coke.

15. The apparatus according to claim 14 wherein the electrode positioned at the discharge opening is provided with a flange and the discharge opening is defined between said flange and the lower end of the furnace wall.

16. The apparatus according to claim 11 wherein said furnace is provided with a gas inlet opening near said coke discharge opening and a gas discharge opening near said coke loading opening, and said apparatus further comprises a circulating conduit connected between said gas inlet opening and said gas discharge opening and a blower connected in series with said circulating conduit.

17. The apparatus according to claim 16 wherein said circulating conduit includes a pair of annular manifolds encircling said furnace and said annular manifolds are connected to said gas inlet opening and said gas discharge opening, respectively.

18. The apparatus according to claim 16 wherein said circulating conduit further includes a dust collector and a heat exchanger which are connected in series with said blower.

19. The apparatus according to claim 13 wherein a heating zone is defined between said pair of electrodes and bypass conduits are provided for said furnace on the outside thereof for bypassing furnace gas around said heating zone.

* * * * *